US005519899A

United States Patent [19]

Taylor

[11] Patent Number: 5,519,899

[45] Date of Patent: May 28, 1996

[54] TOILET ODOR VENTING APPARATUS WITH IMPROVED RETROFIT CAPABILITY

[76] Inventor: Raymond J. Taylor, 10714 E. Burgess Ct., Sun Lakes, Ariz. 85248

[21] Appl. No.: 312,556

[22] Filed: Sep. 26, 1994

[51] Int. Cl.[6] ..... E03D 9/052

[52] U.S. Cl. ..... 4/349; 4/213

[58] Field of Search ..... 4/213, 348, 349, 4/352

[56] References Cited

U.S. PATENT DOCUMENTS

| | | | |
|---|---|---|---|
| 1,736,467 | 11/1929 | Sarrett | 4/213 |
| 1,794,635 | 3/1931 | Mills | 4/213 |
| 1,972,774 | 9/1934 | Hartwell | 4/213 |
| 2,021,402 | 11/1935 | Blodgett, Sr. | 4/215 |
| 2,100,962 | 11/1937 | Juntunen | 4/213 |
| 2,105,794 | 1/1938 | Norris | 4/213 |
| 2,119,529 | 6/1938 | Dick | 4/217 |
| 2,122,687 | 7/1938 | Herrmann | 4/213 |
| 2,126,131 | 8/1938 | Orebaugh | 4/213 |
| 2,279,870 | 4/1942 | Johnson et al. | 4/216 |
| 2,297,935 | 10/1942 | Baither | 4/213 |
| 2,371,923 | 3/1945 | Sanford et al. | 4/213 |
| 2,603,797 | 7/1952 | Baither | 4/214 |
| 2,728,088 | 12/1955 | Judish | 4/217 |
| 3,108,289 | 10/1963 | Smith | 4/213 |
| 3,416,167 | 12/1968 | Klemme | 4/217 |
| 3,763,505 | 10/1973 | Zimmerman | 4/213 X |
| 3,781,923 | 1/1974 | Maisch et al. | 4/213 |
| 3,790,970 | 2/1974 | Bendersky et al. | 4/217 |
| 3,887,949 | 6/1975 | Osmond | 4/217 |
| 4,103,370 | 8/1978 | Arnold | 4/213 |
| 4,166,298 | 9/1979 | Pearson | 4/213 |
| 4,168,553 | 9/1979 | Studer | 4/348 |
| 4,174,545 | 11/1979 | Smith, Jr. | 4/217 |
| 4,222,129 | 9/1980 | Baker | 4/213 |
| 4,365,361 | 12/1982 | Sanstrom | 4/213 |
| 4,583,250 | 4/1986 | Valarao | 4/213 |
| 4,701,966 | 10/1987 | Schafer | 4/213 |
| 4,780,913 | 11/1988 | Williams | 4/217 |
| 5,031,259 | 7/1991 | Baiera et al. | 4/661 |
| 5,079,782 | 1/1992 | Sim | 4/216 |
| 5,161,262 | 11/1992 | Quaintance, Sr. | 4/213 |
| 5,167,039 | 12/1992 | Sim | 4/216 |
| 5,170,512 | 12/1992 | Prisco | 4/213 |
| 5,179,737 | 1/1993 | Picard | 4/213 |
| 5,199,111 | 4/1993 | Antepenko | 4/213 |
| 5,201,079 | 4/1993 | Sowards | 4/216 |
| 5,210,884 | 5/1993 | Redford | 4/348 |
| 5,231,705 | 8/1993 | Ragusa | 4/213 |
| 5,257,421 | 11/1993 | Rose et al. | 4/214 |
| 5,299,326 | 4/1994 | Alexander | 4/209 R |
| 5,305,472 | 4/1994 | Eger | 4/213 |
| 5,369,813 | 12/1994 | Goddard et al. | 4/213 |

FOREIGN PATENT DOCUMENTS

| | | | |
|---|---|---|---|
| 0976026 | 11/1964 | United Kingdom | 4/213 |

*Primary Examiner*—Robert M. Fetsuga

*Attorney, Agent, or Firm*—Charles E. Cates; Richard G. Harrer

[57] ABSTRACT

A toilet odor venting apparatus which fits over the top tank of a toilet in place of the usual tank cover. The apparatus draws air from the toilet bowl through the flush ring into the interior of the tank and then into the room in which the toilet is located. The apparatus includes a suction blower assembly which includes a low profile, disk-shaped impeller journalled for rotation about a vertical axis and one or more low profile electric drive motors, which are preferably DC and which operate at supersynchronous speed. The assembly further includes a special coupling for coupling rotary power from the motors to the impeller with the coupling assembly including a driven wheel journalled for rotation about a vertical axis and a drive wheel journalled for rotation about a horizontal axis. The electric motor is preferably powered by DC current from a battery.

11 Claims, 3 Drawing Sheets

TOILET ODOR VENTING APPARATUS WITH IMPROVED RETROFIT CAPABILITY

BACKGROUND OF THE INVENTION

The present invention relates to toilet odor venting devices, and is directed more particularly to a toilet odor venting apparatus which can be used with toilets having a variety of sizes and configurations, without modifying the toilet and without using any tools.

Prior to the present invention there have been a number of attempts to eliminate the unpleasant odors produced in connection with the use of a toilet in a closed room. One class of these attempts, described in U.S. Pat. Nos. 2,297,935 (Baither), 2,603,797 (Baither), and 5,079,782 (Sim), use suction assemblies which draw malodorous air from a toilet bowl, through the holes of the flush ring thereof, and eject them from the room by venting them into the floor drain of the toilet or into a pressure relief pipe located in the wall of the room. While venting devices of this class are at least partially effective, they have the disadvantage that they must either be built into a new toilet at the time of its construction, or be incorporated into an existing toilet by making extensive modifications thereto.

Another class of attempts to eliminate toilet odors includes retrofitable venting devices which draw malodorous air from the toilet through a specially designed toilet seat or through an inlet which fits between the toilet seat and the toilet bowl. Venting devices of this type are described in U.S. Pat. Nos. 2,728,088 (Gudish), 4,365,361 (Sanstrom), 5,161,262 (Quaintance, Sr.) and 5,231,705 (Ragusa). While venting devices of this type are also at least partially effective, they have the disadvantage that they are cumbersome, visually conspicuous, and spoil the appearance of the toilet.

Still another class of attempts to eliminate toilet odors includes venting devices which are relatively inconspicuous because at least some of their constituent parts are located out of sight in the body or tank of the toilet. Venting devices of this type are described in U.S. Pat. Nos. 1,972,774 (Hartwell), 4,103,370 (Arnold) and 5,201,079 (Sowards). While also somewhat effective, devices of this class have the disadvantage that they are designed to be installed in a toilet at the time of its manufacture. Another disadvantage of odor venting devices of this type is that they bring AC line power in close proximity to the toilet and therefore expose the user thereof to a risk of shock or injury.

SUMMARY OF THE INVENTION

Generally speaking, the venting apparatus of the invention comprises a low profile, self-contained unit which fits over the tank of a toilet in place of the usual tank cover and which establishes through the toilet an air flushing path which extends from the bowl of the toilet to the outlet of the venting apparatus. The flow of air through this path is controlled by an improved low-profile suction blower assembly which is capable, during each minute of operation, of drawing from the bowl of the toilet a volume of air that is substantially greater than the volume of the bowl. Because of the great volume of this air, toilet odors are diluted, i.e., dispersed throughout the ambient air of the room in which the toilet is located, so quickly that their concentration does not rise to objectionable (i.e., noticeable) levels. Since the use of the venting apparatus of the invention does not require that odors be transported outside of the room, it may be used on a purely retrofit basis, i.e., without modifying the toilet or the room in any way.

The ability of the venting apparatus of the invention to produce the above described effect, results in part from its use of a closed, seal-establishing housing which, when fitted over the upper, air-filled region of the toilet tank, restricts the flow of air therethrough to a single path, hereinafter referred to as the flushing or venting path. In one direction this path extends from the tank, through the toilet overflow or equivalent pipe and the internal passages of the toilet to the flush ring and bowl thereof. In the opposite direction this path extends from the inlet of the venting apparatus, and the interior of its housing to the outlet thereof.

When the suction blower assembly is off, the air in the air-filled upper region of the tank is at atmospheric pressure and there is little if any air flow through the flushing path. When the suction blower assembly is on, however, it creates within the air-filled upper region of the tank a negative pressure sufficient to draw a substantial volume of air from the bowl, and within the interior of the housing a positive pressure sufficient eject air at high speed into the room in which the toilet is located. In this way, the venting apparatus of the invention produces within a toilet a gaseous waste flushing action which is analagous to the usual solid and liquid waste flushing action thereof.

In the preferred embodiment the suction blower assembly of the invention includes a low profile, disk-shaped impeller journalled for rotation about a vertical axis and one or more low profile electric drive motors journalled for rotation about respective horizontal axes. These one or more motors drive the impeller at a high, preferably supersyncronous, speed, i.e., a speed greater than that of an AC motor which operates from an AC source such as the commercial AC line that has a fixed frequency. In this manner the suction blower assembly of the invention produces the high pressures necessary to flush air through the toilet and disperse it so quickly that its concentration never rises to objectionable levels.

In the preferred embodiment, the suction blower assembly also includes a coupling assembly for coupling rotary power from the motors to the impeller while compensating for the 90 degree angular displacement between the rotational axes thereof. This coupling assembly and the motors which drive it are preferably located above and adjacent to the impeller. This 90 degree shift and this location together allow the suction blower assembly and the housing within which it is located to have a vertical dimension which is small in relation to the height of the toilet and not significantly larger than the toilet cover that it replaces. This, in turn, allows the venting apparatus of the invention to blend inconspicuously into the lines of the toilet.

In accordance with another feature of the present invention, the one or more motors which drive the suction blower assembly are preferably small permanent magnet DC motors which are powered by a rechargeable battery located within the housing of the venting apparatus. The venting apparatus also includes a switch which may be either manually actuated or seat actuated for supplying power to the motors only when venting is actually needed. Given an adequate ampere-hour rating, the use of a battery to power the motors has been found to be practical, given the intermittent basis on which the venting apparatus is used. The use of a battery provides the additional advantage that it does not bring users of the toilet into proximity with voltages that can cause shock or injury. When the battery does eventually run down, it may be charged, without removing it from the housing of the venting apparatus, via an external plug-in charger through a connector provided in the housing thereof. Thus, the venting apparatus of the invention provides the combined advantages of safety, long-life and ease of maintenance.

In view of the foregoing it will be seen that the venting apparatus of the invention provides a number of advantages over previously known toilet odor venting devices. Firstly, it is highly effective in flushing malodorous air out of the toilet and dispersing and diluting it so quickly that its concentration does not rise to objectionable levels. Secondly, it has a shape and size that allows it to blend inconspicuously into the original lines of the toilet. Thirdly, it may be installed quickly and easily, without modifying the toilet or the room in which it is used, and without the use of any tools. Fourthly, it is easy to use and maintain and presents no risk of shock or injury.

DESCRIPTION OF THE DRAWINGS

Other objects and advantages of the invention will be apparent from the following drawings in which.

DESCRIPTION OF THE PREFERRED EMBODIMENTS

Figure 1:
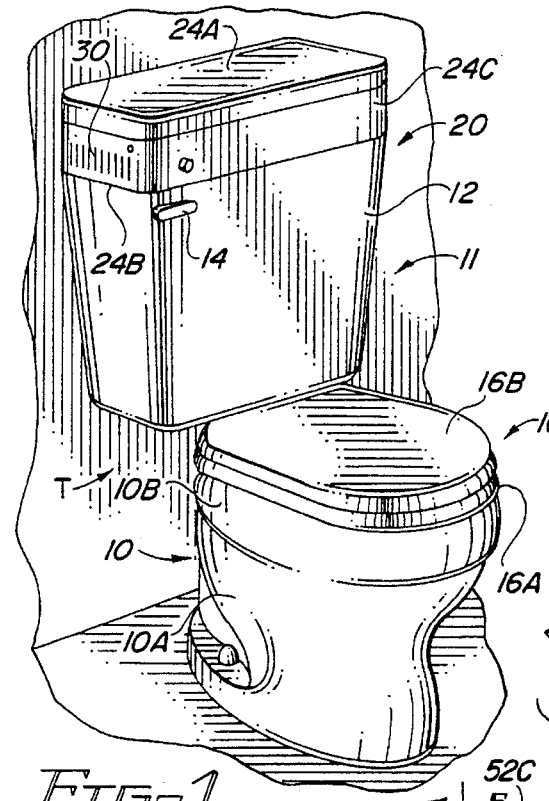
FIG. 1 is an oblique view of a conventional toilet which has been equipped with the venting apparatus of the invention.

Referring to FIG. 1 there is shown in an oblique exterior view of a conventional toilet T which has been equipped with a venting apparatus constructed in accordance with the present invention. Toilet T includes a bowl 10 having a lower, water-filled section 10A and an upper, air-filled section which includes a flush ring 10B of a conventional type, such as that shown in the previously mentioned Baither or Sims patents. Toilet T also includes a tank assembly 11 which here takes the form of a water filled gravity actuated tank 12 for supplying flush water to bowl section 10A and flush ring 10B under the control of a flushing handle 14. Finally, toilet T includes a seat assembly 16, including a hinged annular seat 16A and a hinged seat cover 16B. Because these parts of toilet T are conventional and operate in a conventional manner, neither they nor their operation will be described in detail herein.

Figure 3:
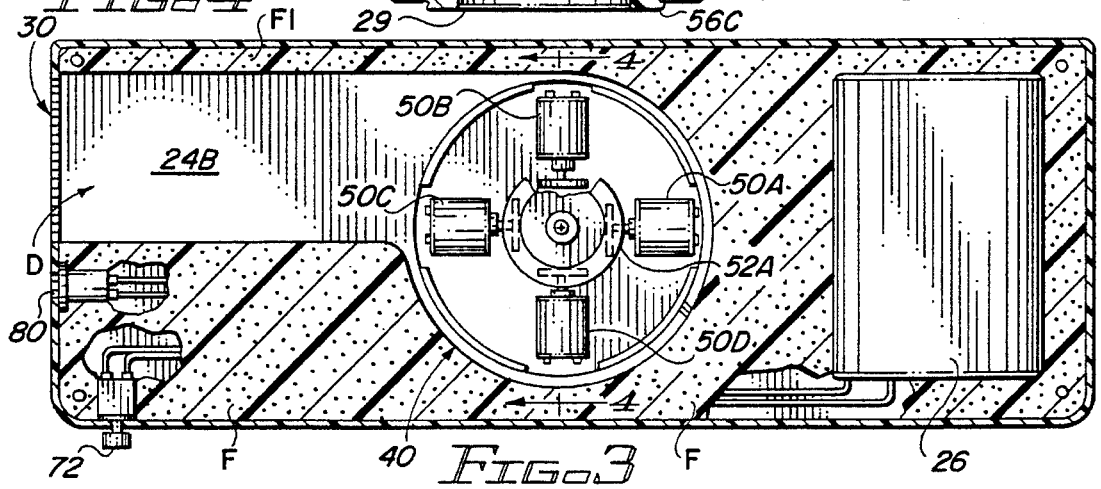
FIG. 3 is a plan view of the venting apparatus shown with its upper cover removed.
Figures 2, 8:
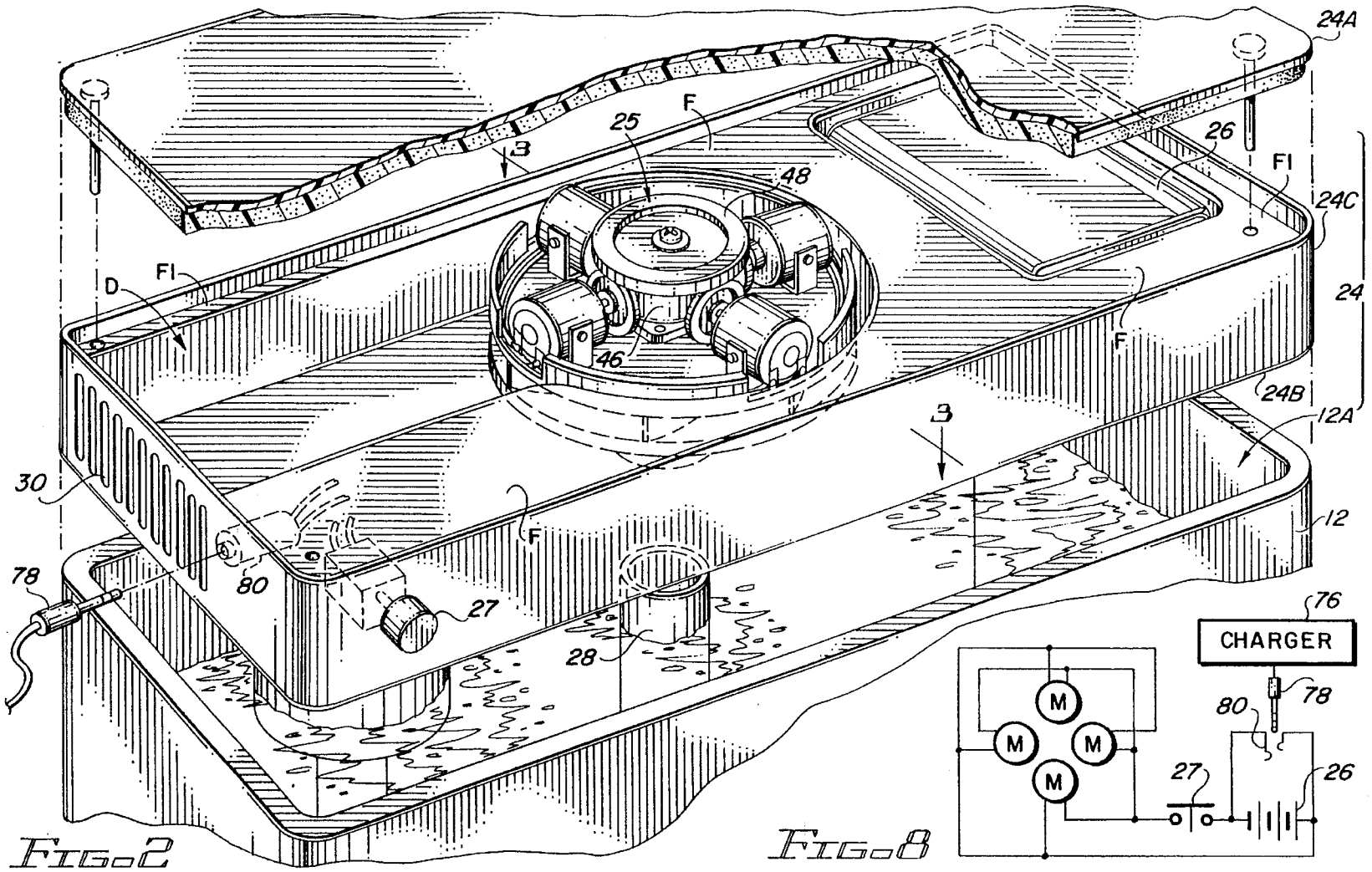
FIG. 2 is an oblique, partially cut-away exploded view of the venting apparatus of the invention and the adjacent portion of the toilet with which it is used.
FIG. 8 is a schematic diagram of the circuitry of the venting apparatus of the invention.

In accordance with the present invention, toilet T of FIG. 1 is equipped with a venting apparatus 20 that includes a housing 24 which fits over the top of tank 12 in place of the usual tank cover. As is best shown in FIGS. 2 and 3, venting apparatus 20 also includes a suction blower assembly 25, a battery 26, and a switch 27 for controllably connecting battery 26 in driving relationship to suction blower assembly 25. In the preferred embodiment suction blower assembly 25 and battery 26 are located within respective openings or pockets which are formed in a body of a suitable fill material F, such as styrofoam, that fills predetermined parts of housing 24 and serves to deaden the sound produced during the operation of venting apparatus 20. Fill body F may also be used to define a shelf for supporting the cover of housing 24 and an outlet duct D that channels air from suction blower 25 to the outlet of housing 24, although the presence of such a duct is not essential to the practice of the present invention.

As shown in FIG. 2, housing 24 includes a top plate or cover 24A, a bottom plate 24B and side plates 24C. Top plate 24A is preferably free of openings and fits within sides 24C, preferably resting on a shoulder F1 formed by the upper surface of fill body F. Bottom plate 24B of housing 24 preferably includes a single inlet opening 24D for an air inlet fitting 29, best shown in FIG. 4. Bottom plate 24B of housing 24 is preferably composed of (or covered by) an elastomeric or semi-elastomeric material and has a length and width which are at least as large as the length and width of the tank of the largest toilet with which it is used. As will be explained more fully presently, this elastomeric quality and these dimensional relationships allow venting apparatus 20 to approximately seal off air-filled upper region 12A of tank 12 and thereby assure that it alone controls the flow of air therethrough.

When positioned as shown in FIG. 1, venting apparatus 20 restricts the path through which air may flow through upper air-filled region 12A of tank 12 to a single path which passes through housing 24. A first part of this path extends from air-filled region 12A through a tank overflow pipe 28, shown in FIG. 2, and the internal passages of the toilet (not shown) to flush ring 10B, the holes of which are open to the ambient air. A second part of this path extends from air-filled region 12A, through an inlet fitting 29 attached to bottom plate 24B of housing 24 of and the interior of housing 24 to an outlet 30 which, in the embodiment of FIG. 2, takes the form of a grill formed in one of the side plates of housing 24. It will therefore be seen that venting apparatus 20 defines and forms a part of an air flushing path which extends from toilet bowl 10 at one end to housing outlet 30 at the other.

As will be explained more fully presently, when venting apparatus 20 is in a first, off state, the pressure of the air in all parts of the flushing path is equal to atmospheric pressure and little or no air flows therethrough. When, venting apparatus 20 is in a second, on state, it establishes a substantial negative or suction pressure within air-filled portion 12A of enclosure 12 and a substantial positive or exhaust pressure within housing 24. As a result, in its on state, apparatus 20 acts as a substantial flushing pressure source that is connected in fluidic series with the flushing path and causes air to flow at a high volume rate of flow into bowl 10, through flush ring 10B, and out of housing outlet 30.

During operation, the pressure gradient produced by apparatus 20 is large enough to establish a volume rate of flow of flushing air which assures that malodorous air from bowl 10 is dispersed into and diluted by room air so quickly that it cannot achieve a concentration which is noticeably objectionable. In this way, the venting apparatus of the invention produces its desired effect without the toilet modifications and/or unsightly external ducts required by prior toilet odor venting devices. It will be understood, however, that there is nothing in apparatus 20 that would preclude the use of such an external duct, and that such a duct may be used if a wall opening is conveniently available and a user finds the sight of such a duct acceptable.

While it might be concluded that the objectionable character of malodorous gas in a room cannot be reduced without reducing the total quantity of malodorous gas in that room, this conclusion is not correct. This is because the objectionable quality of a malodorous gas is a subjective matter that is based on the current concentration of such gas in the immediate vicinity of the nose, while the total quantity of malodorous gas is in a room an objective matter based on the integration throughout the volume of the room, of the concentration of that gas as a function of its position therein. In the creation of the present invention it was discovered that malodorous air is much more objectionable when it hovers in concentrated clumps and layers in a given volume of still air (in much the same way that cigarette smoke hovers in clumps and layers) than when it is dispersed more or less uniformly throughout the same volume of moving air. Thus, the apparatus of the invention achieves the apparently paradoxical result of eliminating the objectionable quality of a malodorous gas without elimination the malodorous gas itself.

In accordance with the present invention the above described high pressure gradient and high volume rate of air flow are produced by suction-blower assembly 25. This suction blower assembly preferably has a vertical dimension which is small in relation to the vertical dimension of toilet T. This, in turn, allows the vertical dimension of housing 24 of venting apparatus 20 to be small in relation to that of toilet T. This low vertical profile assures that, when venting apparatus 20 is installed in place of the usual toilet cover, as shown in FIG. 1, it becomes inconspicuous and blends in with the overall lines of toilet T.

Figure 4:
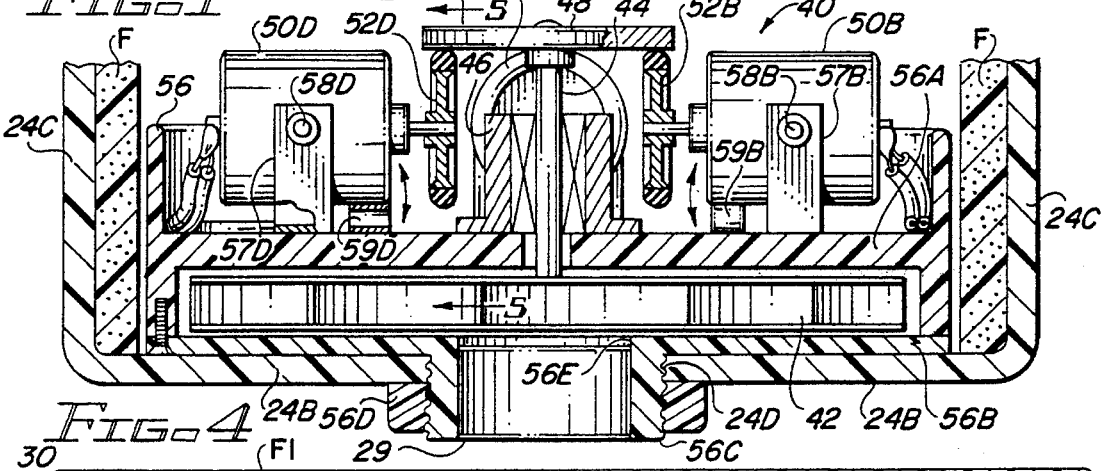
FIG. 4 is a fragmentary cross-sectional view of the venting apparatus taken along the section 4—4 of FIG. 3.

The structure and operation of the preferred embodiment of suction blower assembly 25 will now be described. Referring to FIG. 4, suction blower assembly 25 includes a low profile disk shaped impeller 42 (best shown in FIGS. 9 and 10), an impeller drive shaft 44 journalled for rotation about a vertical axis by a suitable bushing 46, and an impeller drive wheel 48. Suction blower 25 also includes one or more drive motors 50A through 50D which are arranged to drive impeller drive wheel 48 through respective drive wheels 52A through 52D. As is best shown in FIGS. 2 and 4, drive wheels 52A, etc. are journalled for rotation about respective horizontal axes, and drive impeller drive wheel 48 from the underside thereof by means of a frictional engagement therewith. Thus, drive wheels 48 and 52A through 52D together comprise a coupling assembly for coupling the rotary power which motors 50A through 50D produce along respective horizontal axes to impeller 42 to rotate the latter about its vertical axis.

As is best shown in FIG. 3, suction blower assembly 25 is mounted on a mounting assembly 56 that includes an upper central shelf 56A for supporting impeller 42, drive shaft 44, bushing 46, drive motors 50A through 50D and the coupling assembly. Mounting assembly 56 also includes a lower central shelf 56B having a centrally disposed threaded projection 56C and a threaded ring 56D for securing mounting assembly 56 to housing bottom plate 24B via housing inlet hole 24D. Threaded projection 56C also defines the inlet passage 56E through which suction blower 25 draws air from the air-filled region of tank 12.

Because mounting assembly 56 and all of the devices mounted thereof have relatively small vertical dimensions, and because all of these elements are mounted compactly in a manner which minimizes the amount of vertical space they occupy, suction blower assembly 25 as a whole has a vertical dimension which is relatively small. This, in turn, allows the use of a housing having vertical dimension which is small in relation to the vertical dimension of toilet T. As a result, the apparatus of the invention occupies a vertical space which is not substantially greater than the toilet cover it replaces. This, together with horizontal dimensions which approximate those of the tank with which it is used, allows the lines of the apparatus of the invention to blend inconspicuously with those of the toilet.

In spite of the showing of four impeller drive motors in FIGS. 2 and 3, there is no necessary correlation between the result produced by venting apparatus 20 and the number of motors utilized therein. The determining factor in the choice of the number and kind of motors used is whether or not they are able to produce the torque necessary to drive impeller 42 at the high rotational speeds necessary to produce the volume rates of air flow contemplated by the present invention. The reason that four motors were chosen for the embodiment of FIGS. 2, 3 and 4 is that each motor is a type of permanent magnet DC motor which, although it combines the qualities of low cost with a low profile and the ability to operate at high speeds, is able to provide only about one-quarter of the torque necessary to produce the desired volume rate of air flow. It will therefore be understood that, if a single motor having the desired low profile, output torque and high speed capability is available, that single motor may be used in suction blower assembly 25 without departing from the spirit and scope of the present invention.

Figure 9:
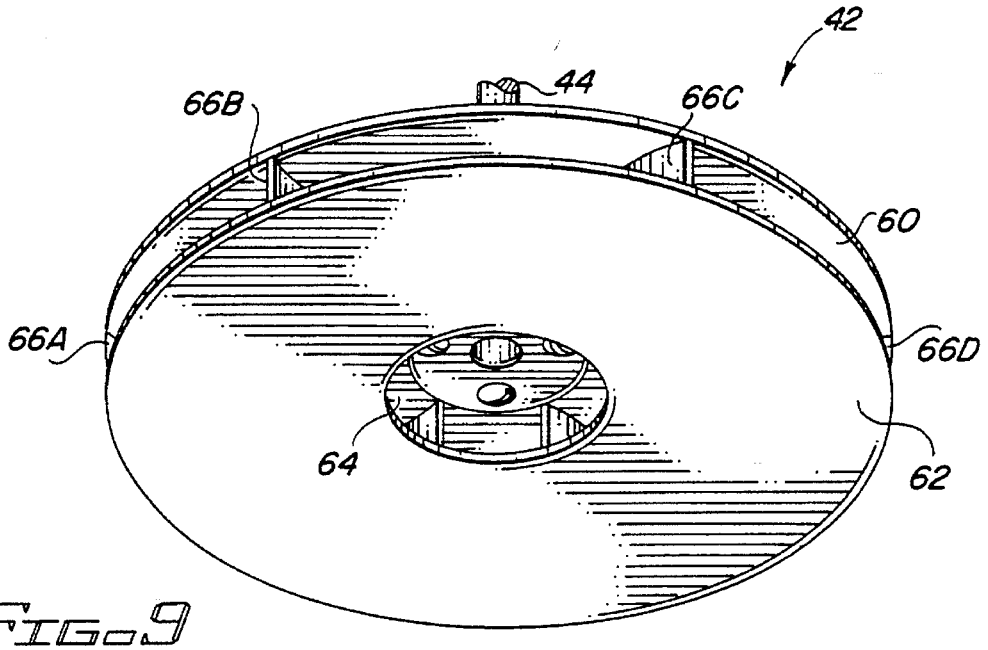
FIG. 9 is an oblique view of the underside of an impeller suitable for use in practicing the present invention.
Figure 10:
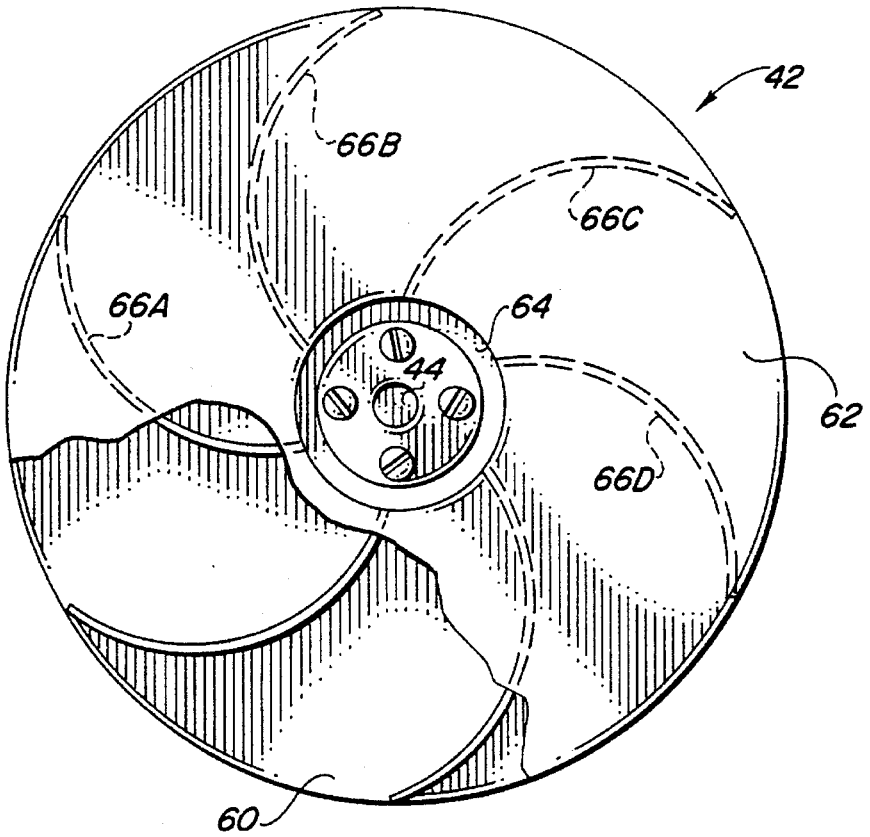
FIG. 10 is a partly cut away plan view of the underside of the impeller of FIG. 9.

Referring to FIGS. 9 and 10 there are shown oblique bottom and partially cutaway bottom views of one low profile impeller which is suitable for use in suction blower assembly 25. This impeller preferably includes an upper plate 60 which is free of openings, a lower plate 62 having a central opening 64, and a plurality of impeller blades 66A, 66B, etc.. Each of the latter preferably extends from the outer periphery of plates 60 and 62 toward central opening 64, and each has a spiral like or spiriferous shape. When impeller 42 is rotated at high speed, air is driven radially outwardly by impeller blades 66A, etc. to produce a high pressure at the outer edge thereof and a low pressure within central opening 64 thereof.

In accordance with the present invention, the low pressure within central inlet 64 of impeller 42 is applied to the air-filled region 12A of tank 12 through mounting assembly passage 56E, the upper end of which is located in close proximity to impeller inlet 64. (The latter proximity is desirable because it prevents air within the open interior of housing 24 from being drawn into inlet 64 and thereby forming a part of a useless circulation within housing 24). Since the presence of housing 24 prevents air from flowing into air-filled region 12A of tank 12 except through overflow pipe 28 and flush ring 10B of toilet T, the negative pressure of impeller inlet 64 causes air from the toilet bowl to be sucked forcefully into housing 24. Once the latter air is inside of housing 24, the high pressure at the the periphery of impeller 42 drives it forcefully out of housing 24 through housing outlet 30. Thus, as previously explained, the flushing apparatus of the invention sucks air from bowl 10 of toilet T and expels it at high speed into the ambient air.

The component sizes and ratings contemplated by the present invention will be apparent from the following description of a representative specific example. For a toilet with a bowl having a typical size, e.g., having an air-filled volume of approximately 10 liters, good results have been achieved with an impeller of the type shown in FIGS. 9 and 10 having a diameter of approximately 12½ cm, a central opening of approximately 4½ cm, and a plate separation of approximately 1 cm, which is driven at a rotational speed of approximately 6500 rpm. At this speed, it has been found that the air within the toilet bowl is changed approximately twenty times during each minute that the suction blower assembly of the invention is operating at full speed. Stated differently, during each minute of suction blower operation, the apparatus of the invention exhausts into the ambient air a volume of air approximately twenty times greater than the volume of air in the air-filled portion of the toilet bowl.

The effect of such volume rates of flow on the apparent concentration of malodorous air in the room surrounding the toilet is actually somewhat greater than the numerical values of these volumes indicate. This is because this volume of air is flushed from the toilet at a velocity which hastens its dispersion throughout the air of the room. While the velocity of the air flowing out of housing 24 is difficult to measure accurately, its speed may be approximated on the basis of the calculated velocity of air flowing through overflow pipe 28. Based on approximate measurements of the cross-sectional area of the latter pipe (5 $cm^2$) and the pressure head produced by suction blower 25 (65 to 130 cm of water), the latter rate of flow is estimated at 1500 to 3000 cm (50 to 100 feet) per second. Thus, depending upon the relative cross sectional areas of housing outlet 30 and overflow pipe 28, the velocity of air flowing out of housing 24 may be from 300 to 600 cm (10 to 20 feet) per second.

The results described in the foregoing example have been found to be readily achievable using small, inexpensive 12 volt, 11,500 RPM permanent magnet DC motors which are powered from battery 26 that is connected thereto as shown in the circuit of FIG. 8, all components shown in the latter circuit being labeled with the same numbers used to identify the corresponding elements in FIGS. 1 through 4. In the circuit of FIG. 8, switch 27 is preferably a push button switch of the type which closes and stays closed when pushed a first time, and opens and stays open when pushed a second time. Battery 26 is preferably of the rechargeable type having a rating of, for example, 8 ampere-hours, and may be recharged by a charger 76, of the type commonly used to power hand-held calculators, through a conventional male DC connector 78 which plugs into a matching female connector 80 mounted in housing 24. It will be understood that most or all of the connecting wires of the circuit of FIG. 8 either are not shown in FIG. 1 through 4 for the sake of clarity or are not visible therein because they are obscured by fill body F.

Given the above described structures and connections, the operation of the apparatus of the invention may be summarized as follows. Between usages of toilet T, switch 27 is in its off state and suction blower 25 produces no suction pressure within air-filled region 12A of tank 12 and no blowing pressure within housing 24. Under this condition all parts of the flushing passage through toilet T and venting apparatus 20 are at atmospheric pressure and little or no air flows therethrough. Before a user uses the toilet he pushes button 27 to turn on suction blower 25, which then begins to produce the pressure gradient which causes flushing air to be drawn from bowl 10 and exhausted through outlet 30 of housing 24. Operation in this mode continues until the user is ready to flush the toilet, at which time he pushes button 27 a second time to turn off suction blower 25. This turn off is important to the proper flushing of solid and liquid waste from the toilet because the suction pressure created by suction blower 25 is powerful enough to restrict the release of flush water to bowl 10 when flush handle 14 is depressed. Once the water flushing action is completed, both the toilet and the apparatus of the invention are restored to their initial condition and are ready to be used again.

From the foregoing it will be seen that the apparatus of the invention operates only intermittently, i.e., only during the time that the time that toilet T is actually being used. Because of this intermittent operation, the energy consumption of venting apparatus 20 is relatively small when averaged over a prolonged period of time. As a result, a rechargeable battery having a rating of as little as 8 ampere-hours should be adequate to operate the apparatus for weeks or even months, depending upon the frequency with which it is used. When battery 26 does eventually run down, it may be recharged without removing it from housing 24, by plugging charger 76 into an AC outlet and keeping male plug 78 plugged into charging plug 80 until recharging is complete. The fact that charger 76 may provide only a small charging current is not a problem since it is applied continuously over a long period, such as overnight, while discharging current from battery 26 flows only infrequently and for short periods.

While the preferred embodiment of the invention uses a manual on/off switch 27, the invention may also be practiced with an automatic (e.g., seat actuated) on/off switch. The switch may, for example, be actuated by the weight of a user on seat 16A of toilet T, as described in U.S. Pat. No. 4,222,129 (Baker) or U.S. Pat. No. 2,603,797 (Baither), which are hereby incorporated by reference. In addition, either of these types of switches may be used with a built-in timer for automatically turning off the suction blower assembly a predetermined time after it is turned on. Because seat actuated switches and timers are well-known to those skilled in the art, they will not be described in detail herein.

Figure 5:
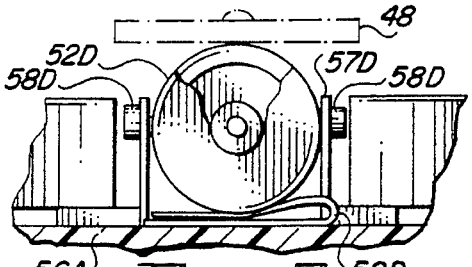
FIG. 5 is a fragmentary end view of the suction blower assembly of the invention taken along the section 5—5 of FIG. 4.

In practicing the present invention it has been discovered that there are certain secondary features which, though not essential to the operation thereof, make its operation more effective and practical. One of these is the inclusion of a horizontally pivotable mounting for each of drive motors 50A through 50D, one example of which is shown in FIG. 5. As shown in FIG. 5 this pivotable mounting includes a generally U-shaped bracket 57D in which motor 50D is pivotally mounted by a pair of pivot elements 58D. Cooperating with this mounting is a low profile spring 59D which tends to push the front end of motor 50D upwardly to assure that a firm frictional driving engagement is maintained between motor drive wheel 52D and impeller drive wheel 48. Because of this firm driving engagement, the coupling assembly of suction blower 25 operates smoothly and steadily without excessive noise or vibration. This driving action may be further improved by including on the driving surfaces of motor drive wheels 52A through 52D and impeller drive wheel 48 elastomeric pads or treads which both cushion the driving engagement and increase the coefficient of friction therebetween.

Figure 6:
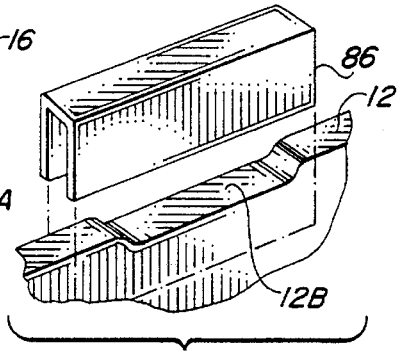
FIGS. 6 and 7 are respective fragmentary oblique and end views of one embodiment of a blocking member which may be used with the venting apparatus of the invention.
Figure 7:
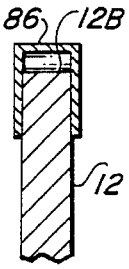

Another secondary feature of the present invention is the use of one or more blocking members for blocking off the openings, such as 12B in FIGS. 6 and 7 which are formed in the tanks of toilets to provide pressure relief during flushing. The blocking of these openings is desirable because, if left unblocked, they allow ambient air to leak into air-filled space 12A of tank 12 (i.e., enter without being drawn through overflow pipe 28) and thereby reduce the desired high suction pressure within tank 12. This reduction in suction pressure is undesirable because it decreases the efficiency with which suction blower 25 can flush air from bowl 10.

One type of blocking member suitable for use in eliminating the above-mentioned leakage is the clip 86 shown in FIGS. 6 and 7. As shown in the latter Fig. this clip is a U-shaped piece of metal or plastic having an opening with a width approximately equal to the thickness of tank 12, and a length and depth comparable to the length and depth of pressure relief opening 12B to be blocked. In addition, clip 86 should be relatively thin so that it does not introduce an appreciable air gap between the upper surface of tank 12 and the bottom plate of apparatus 20. In the event of the non-availability of a clip that meets these conditions for a particular toilet, the desired blocking effect may be achieved with a wad of plumber's putty which is shaped in place to block the pressure relief opening and define an upper surface which can form an approximately sealing engagement with the bottom plate of the apparatus of the invention.

While the present invention has been described with reference to a particular embodiment, it will be understood that the true spirit and scope of the present invention should be determined only with reference to the appended claims.

What is claimed is:

1. A venting apparatus for use with toilets of the type having a tank including a flush valve for controllably releasing a charge of flush water, a tank cover adapted to rest on the top of the tank, and a bowl having a flush ring, said toilet defining an internal passage, through which said flush ring is connected to the interior of the tank when the flush valve is closed including, in combination:

a) a housing which has a vertical dimension that is small in relation to the vertical dimension of the toilet, and which is adapted to rest on said tank, in place of said cover, and to form a sealing engagement with said tank, said housing:

(i) defining an inlet through which air may be sucked into the housing from said tank; and (ii) defining an outlet through which air within the housing may be exhausted into the ambient air;

b) an impeller located within the housing; adjacent to said inlet;

c) an electric motor located within the housing for driving said impeller;

d) a supply of electrical energy to said motor;

e) a switch for turning said motor on and off; and f) a coupling assembly for coupling said motor to said impeller, said coupling assembly including a driven wheel journalled for rotation about a vertical axis and at least one drive wheel journalled for rotation about a horizontal axis.

2. The apparatus of claim 1 in which said motor has a vertical dimension which is small in relation to the vertical dimension of the housing, and which further includes a mounting for said motor and said coupling assembly between said housing and said impeller.

3. The apparatus of claim 1 in which said electric motor includes a plurality of DC motors, and in which said coupling assembly includes a plurality of drive wheels disposed between respective DC motors and said driven wheel.

4. The apparatus of claim 1 further including a pivotable mount for pivotally mounting said motor, and a spring connected to the motor for maintaining the drive wheel in driving contact with said driven wheel.

5. A venting apparatus for use with toilets of the type having a tank including a flush valve for controllably releasing a charge of flush water, a tank cover adapted to rest on the top of the tank, and a bowl having a flush ring, said toilet defining an internal passage through which said flush ring is connected to the interior of the tank when the flush valve is closed including, in combination:

a) a housing which has a vertical dimension which is small in relation to the vertical dimension of the toilet and which is adapted to rest on the top of said tank in place of said cover, said housing:

(i) defining an inlet through which air may be drawn into the housing through the flush ring and said internal passage; and (ii) defining an outlet through which air within the housing may be expelled from the housing;

b) an impeller journalled within the housing for creating a region of reduced pressure adjacent to said inlet, said impeller having a disk-like configuration and which rotates about an axis which is substantially vertical, the vertical dimension of said impeller being small in relation to the vertical dimension of said housing;

c) at least one DC electric motor within the housing for driving said impeller at a supersynchronous speed high enough to assure that air drawn from the bowl of the toilet is mixed with ambient air rapidly enough to substantially reduce the apparent concentration of malodorous gases therein, said motor further having a horizontal axis of rotation and a vertical dimension which is small in relation to the vertical dimension of said housing;

d) a battery for supply of electrical energy to said motor; and e) a switch for controllably connecting said energy supply to said motor.

6. The apparatus of claim 5 in which the impeller includes an upper plate, a lower plate which defines a central opening, and a plurality of generally spiriferous blades disposed between said plates, the central opening of said lower plate being positioned adjacent to said inlet.

7. The apparatus of claim 5 further including a coupling for coupling said at least one motor in driving relationship to said impeller.

8. The apparatus of claim 7 in which said coupling includes a driven wheel that is attached to the impeller and that is journalled for rotation about a vertical axis, and at least one drive wheel that is attached to a respective motor and that is journalled for rotation about a horizontal axis.

9. The apparatus of claim 8 in which the motor and the coupling are mounted above and adjacent to the impeller.

10. The apparatus of claim 8 further including at least one pivotable motor mount for pivotally mounting a respective motor, and at least one spring connected to a respective pivotable motor mount for urging the respective drive wheel into driving engagement with said driven wheel.

11. The apparatus of claim 8 in which the diameters of said drive and driven wheels are different, whereby said coupling may drive said impeller at a speed that is different from the speed of said motor.

* * * * *